US008251102B2

(12) United States Patent
Mettler

(10) Patent No.: US 8,251,102 B2
(45) Date of Patent: Aug. 28, 2012

(54) HEDDLE FRAME

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 1209 days.

(21) Appl. No.: 11/240,531

(22) Filed: Oct. 3, 2005

(65) Prior Publication Data

US 2006/0070680 A1 Apr. 6, 2006

(30) Foreign Application Priority Data

Oct. 1, 2004 (DE) ..... 10 2004 047 929

(51) Int. Cl.
*D03C 13/00* (2006.01)
*D03C 9/06* (2006.01)

(52) U.S. Cl. ..... 139/93; 139/82; 139/83; 139/84; 139/88; 139/92

(58) Field of Classification Search ..... 139/82, 139/83, 84, 88, 91, 92
See application file for complete search history.

(56) References Cited

U.S. PATENT DOCUMENTS

| | | | | |
|---|---|---|---|---|
| 3,349,810 | A * | 10/1967 | Goodman, Jr. | 139/92 |
| 4,088,158 | A * | 5/1978 | Kennedy | 139/92 |
| 4,506,707 | A * | 3/1985 | Shimizu | 139/91 |
| 5,004,019 | A * | 4/1991 | Blontrock | 139/91 |
| 5,005,607 | A * | 4/1991 | Shimizu | 139/91 |
| 5,152,324 | A * | 10/1992 | Froment | 139/82 |
| 5,249,605 | A * | 10/1993 | Graf | 139/91 |
| 5,335,699 | A | 8/1994 | Beyaert et al. | |
| 5,887,629 | A * | 3/1999 | Mettler et al. | 139/91 |
| 6,446,676 | B1 * | 9/2002 | Magri et al. | 139/92 |
| 6,994,123 | B2 * | 2/2006 | Mettler | 139/93 |
| 7,032,624 | B2 * | 4/2006 | Bruske et al. | 139/57 |

FOREIGN PATENT DOCUMENTS

| | | |
|---|---|---|
| EP | 0 467 808 A1 | 1/1992 |
| EP | 0 520 540 A1 | 12/1992 |

* cited by examiner

*Primary Examiner* — Bobby Muromoto, Jr.
(74) *Attorney, Agent, or Firm* — Fitch, Even, Tabin & Flannery, LLP

(57) ABSTRACT

A heddle frame (1) is driven via drive rods (15), which pass through its lateral sampsons (13). To that end, the lateral sampsons (13) each have a corresponding channel (19). The play between the circumferential face (22) of the drive rods (15) and the channel wall face (21) of the respective channel (19) has an intermediate layer (24), which extends over the full length, or portions, of the drive rod (15). The intermediate layer (24) preferably comprises an impact-proof, permanent-elastic, damping material. A slight residual play allows the introduction of the drive rods (15) and the intermediate layer (24) into the channel (19) without force.

11 Claims, 4 Drawing Sheets

HEDDLE FRAME

CROSS REFERENCE TO RELATED APPLICATION

This application claims the priority of German Patent Application No. 10 2004 047 929.1, filed on Oct. 1, 2004, the subject matter of which, in its entirety, is incorporated herein by reference.

FIELD OF THE INVENTION

The invention relates to a heddle frame for a power loom.

BACKGROUND OF THE INVENTION

From European Patent Disclosure EP 0 520 540 A1, a heddle frame is known, having two frame rods, disposed horizontally at a spacing from one another, which are joined on their respective ends by a respective vertical lateral sampson. The lateral sampsons and the frame rods thus form a rectangular frame, called a heddle frame. Support rails on which heddles are seated are retained on the frame rods. Each heddle has an eyelet through which a warp yarn extends. Moving the entire heddle frame up and down opens or closes sheds into which weft yarns are to be inserted. Drive bars that extend all the way through the lateral sampsons serve to move the heddle frame. To that end, each lateral sampson is provided with a hollow chamber, which is accessible at its lower end through a threaded opening and at its upper end through a through bore. The drive rod is provided with threads on its upper and lower ends. It extends through the hollow chamber of the lateral sampson, and its male thread meshes with the thread of the threaded bore of the lateral sampson. Its other end extends through the through bore, where it is locked or clamped by means of a nut that is braced on the surface of the lateral sampson that surrounds the through bore.

The drive rod is provided on its lower end with a coupling device, which is in engagement with the drive mechanism. For changing the heddle frame, the drive rods are uncoupled, so that the heddle frame can be removed along with the drive rods from the power loom. The accessibility of the coupling devices is limited.

From European Patent Disclosure EP 0 467 808 A1, a connecting system between drive rods and heddle frames is known, in which the heddle frame is connected at its upper end to the drive rod or to a drive cable. Serving as the connecting device is a hook whose jaw is in positive engagement with a corresponding profile of the drive rod, and whose other end is connected to the lateral sampson. The drive rod or the drive cable extends through a groovelike channel in the lateral Sampson.

In all the arrangements described above, and particularly the last one, limited buckling of the drive rod can occur. The buckling occurs especially under load, because of the strong compressive forces acting on the drive rods. These forces can damage the groove or bore through which they extend. Such damage consequently rapidly causes failure of the lateral sampsons, which break. The damage reduces the already low fatigue strength of the lateral sampsons, which typically are of aluminum.

With this as the point of the departure, it is the object of the invention to create an improved heddle frame whose lateral sampsons have a longer service life.

SUMMARY OF THE INVENTION the above object is generally attained by a heddle frame according to the present invention having two lateral sampsons, in which an intermediate layer is located between the drive rods and the corresponding channel of the lateral sampson. The intermediate layer limits the space available laterally next to the drive rod and thus prevents the drive rod from buckling laterally under a pressure load and also prevents lateral vibration of the drive rod. Direct contact is also prevented between the lateral sampson and the drive rod, thus preventing damage to the material comprising the lateral sampson. The intermediate layer preferably comprises a permanent-elastic plastic, such as polyamide, or rubber.

By avoiding the impact of the bare drive rod on the channel wall face, a quieter shaft motion is furthermore achieved. The intermediate layer between the drive rod and the channel wall face can not only damp or prevent contact between the drive rod and the channel wall face but also, given suitable dimensioning, can prevent the buckling of the drive rod entirely. As a result, interfering shocks and damage to the drive rod or its thread that would otherwise occur are averted entirely.

Disposing the intermediate layer between the channel wall face and the drive rod makes it possible to locate the connecting device, for connecting the drive rod to the lateral sampson, on the upper end of the lateral sampson; the drive mechanism is located below the heddle frame. The damped guidance of the drive rod in the lateral sampson thus makes it possible to transmit shear force over a relatively long portion of the drive rods, thus averting the risk of buckling within the lateral sampson.

In the exemplary embodiment, the intermediate layer is secured to the drive rod. It can be applied for instance by simply slipping a hoselike structure over the entire free length of the drive rod and then shrinking it in place. It is furthermore possible to provide the drive rod with a plastic layer. This layer can be applied by injection molding, either in a single operation or layer by layer. It can also be made either all at once or layer by layer by an immersion method, for instance. The sheathing of the drive rod with plastic that is thus attained represents the intermediate layer and forms a damping support for the rod. At the same time, the sheathing laterally braces the drive rod and thus prevents it from buckling.

The channel may be embodied as a bore or as an open groove. In its embodiment as a bore, the best bracing of the drive rod is achieved. The bore may be embodied with a round or polygonal cross section. In the preferred case, the channel wall face with the sheathed drive rod defines a narrow play of only 0.1 to 0.9 mm.

If the channel is embodied as a groove, a pronounced effect is still achieved. The buckling of the drive rod is avoided at least in three main directions.

The intermediate layer may if needed also be introduced into the lateral sampson. For that purpose it may for instance be embodied as an axially stretchable hose, which in the axially stretched and thus reduced-diameter state is drawn into the channel, embodied as a bore, in the frame rod and then released. It thereupon contracts axially and stretches again radially, pressing against the channel wall face in the process. The seating of the hose in the channel can be improved by means of adhesive or glue. When the channel is embodied as an open groove, the intermediate layer may be glued in place in the form of a plastic strip or introduced into the groove by injection or other application methods.

Finally, it is also possible to embody the intermediate layer as a separate element, which is joined to neither the channel wall face nor the circumferential face of the drive rod. In that case, it sits loosely, with slight play, on the drive rod and in the channel.

In an especially advantageous embodiment, the lateral sampson is provided, on an end preferably remote from the connecting device, with a guide piece through which the drive rod extends. The guide piece is preferably dimensioned such that it receives the drive rod without play. In a further preferred embodiment, the intermediate layer extends through the guide piece and is seated without play in it. The guide piece may be embodied as a bush or as a U-shaped guide part with a jawlike opening. Preferably, it is of hardened steel. These provisions make for buckle-free support and guidance of the drive rod in the lateral sampson. This prevents damage to the thread of the drive rod, particularly in embodiments in which the connecting device is formed by screwing the end of the rod to a suitable threaded bore or threaded element of the lateral sampson. Tendencies of the drive rod to buckle in such connecting devices would rapidly cause thread damage and thus, sooner or later, would cause the failure of the lateral sampson. This is avoided.

Further details of advantageous embodiments of the invention will become apparent from the drawing or the description or are the subject of claims.

In the drawing, exemplary embodiments of the invention are shown.

DETAILED DESCRIPTION OF THE INVENTION

Figure 1:
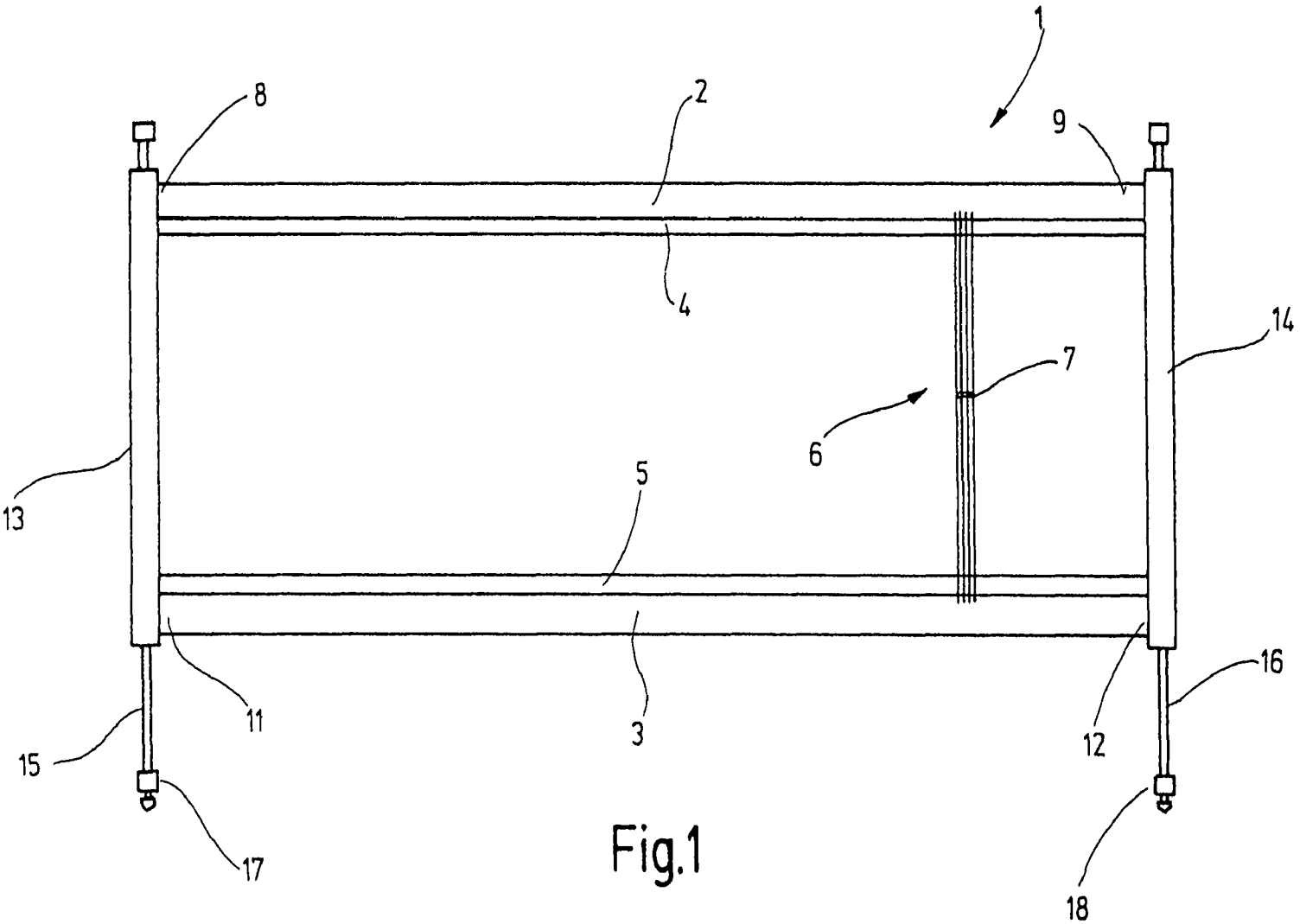
FIG. 1 is a schematic front view of a heddle frame.

In FIG. 1, a heddle frame 1 is shown that is intended for a high-speed power loom. The heddle frame includes frame rods 2, 3, which are embodied for instance as hollow aluminum profile sections. Supported on them are steel support rails 4, 5, on which heddles 6 are seated. The heddles each have an eyelet 7 for a warp yarn. With the heddle frame 1, the warp yams are moved upward and downward out of the warp yarn plane, in order to open and close sheds.

The frame rods 2, 3 are joined on their respective ends 8, 9, 11, 12 to lateral sampsons 13, 14, which in use are as a rule oriented vertically. The lateral sampsons 13, 14 with the frame rods 2, 3 form a rectangular frame. The lateral sampsons 13, 14 are guided longitudinally, or in other words in the present case vertically displaceably, either directly or via suitable guide means. To effect this driving motion, drive rods 15, 16 are provided, which extend through the lateral sampsons 13, 14. The drive rods 15, 16, with their respective lower ends 17, 18, are in communication with a drive mechanism, not further shown. For instance, suitable coupling pieces may be provided on the ends 17, 18.

Figure 2:
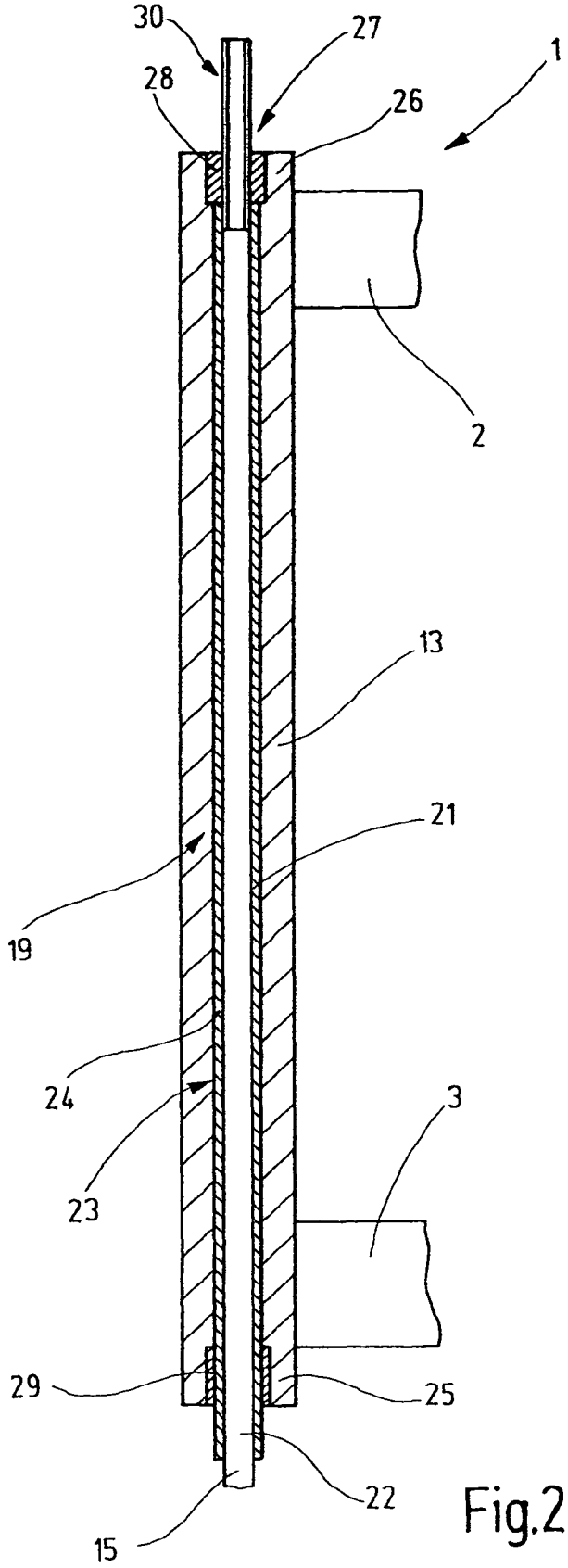
FIG. 2 is a vertical section through a lateral sampson of the heddle frame of FIG. 1.

As seen from FIG. 2, the lateral sampson 13, for receiving the drive rod 15, has a longitudinally continuous channel 19, which has a substantially cylindrical channel wall face 21. The diameter of the channel 19 is greater by from 0.5 mm to a maximum of 3 mm than the diameter of the preferably cylindrical drive rod 15. Thus between the channel wall face 21 and the circumferential face 22 of the drive rod 15, an intermediate space 23 remains. It is largely filled with an intermediate layer 24. This is true at least for the case of the circular channel cross section. However, the channel cross section may also be square or polygonal, and in that case the play between the drive rod 15 and the channel wall face should also be in the range from 0.5 mm to 3 mm.

The intermediate layer 24 extends preferably over the entire portion of the drive rod 15 that is located in the channel 19. The intermediate layer may for instance be embodied as a closed hose of smooth or profiled surface, or as a hose provided with openings or in netlike fashion, which is seated on the circumferential face 22. For instance, it may be formed by a polyamide hose or by a hose of some other impact-damping plastic. The drive rod 15 may equally well be provided with an elastomer sheath. For applying a polyamide hose, this hose may for instance first be slipped with a larger diameter onto the drive rod 15 and then subjected to a shrinkage process, so that it is seated firmly on the drive rod 15.

While the polyamide hose that forms the intermediate layer 24 protrudes out from the lower end 25 of the lateral sampson 13, it leaves the upper end of the drive rod 15, protruding out of the upper end 26 of the lateral sampson 13, free. This free end is provided here with a male thread 27, which serves to establish a connection between the lateral sampson 13 and the drive rod 15. For that purpose, a threaded insert 28, for instance of steel, is also inserted into the upper opening of the channel 19. This insert is solidly joined to the lateral sampson 13. It may be secured in the lateral sampson 13 by positive and/or material and/or nonpositive engagement. Such threaded inserts are known, for instance under the tradenames Helicoil and Ensat.

For further improving the guidance of the drive rod 15 in the lateral sampson 13, the lateral sampson is preferably provided on its lower end 25 with a bush 29, preferably of hardened steel. The bush receives the drive rod 15 without play on its sheath formed by the intermediate layer 24. The bush 29 may be hammered, glued or screwed into the widened lower opening of the channel 19. The lateral sampson 14 and the drive rod 16 are constructed as mirror images of the drive rod 15 and lateral sampson 13 described above. The above description thus applies accordingly. Both drive rods 15, 16 are connected to the corresponding lateral sampsons 13, 14 at their respective upper ends.

The heddle frame 1 described thus far functions as follows:

In operation, the drive rods 15, 16 serve to move the heddle frame 1 rapidly up and down. For transmitting the upward motion, the drive rods 15, 16 transmit a compressive force from their respective lower ends 17, 18 to the upper ends of the lateral sampsons 13, 14. Because of the compressive force to be transmitted and because of existing vibration, the drive rods 15, 16 have the tendency to buckle laterally. This tendency is countered by the bushes 29, inserted into the lateral sampsons 13, 14, and by the intermediate layer 24, which prevents buckling of the drive rod 15, 16 inside the channel 19 of the lateral sampson 13, 14. First, the intermediate layer 24 fills the intermediate space 23 and thus already by this provision prevents lateral deflection of the drive rod 15, 16. Second, it damps impact upon contact, if the drive rod 15, 16 vibrates inside the channel 19. In this way, with relatively thin drive rods 15, 16, major driving forces can be securely transmitted, and the heddle frame 1 follows the motion of the drive rods 15, 16 precisely.

Figure 3:
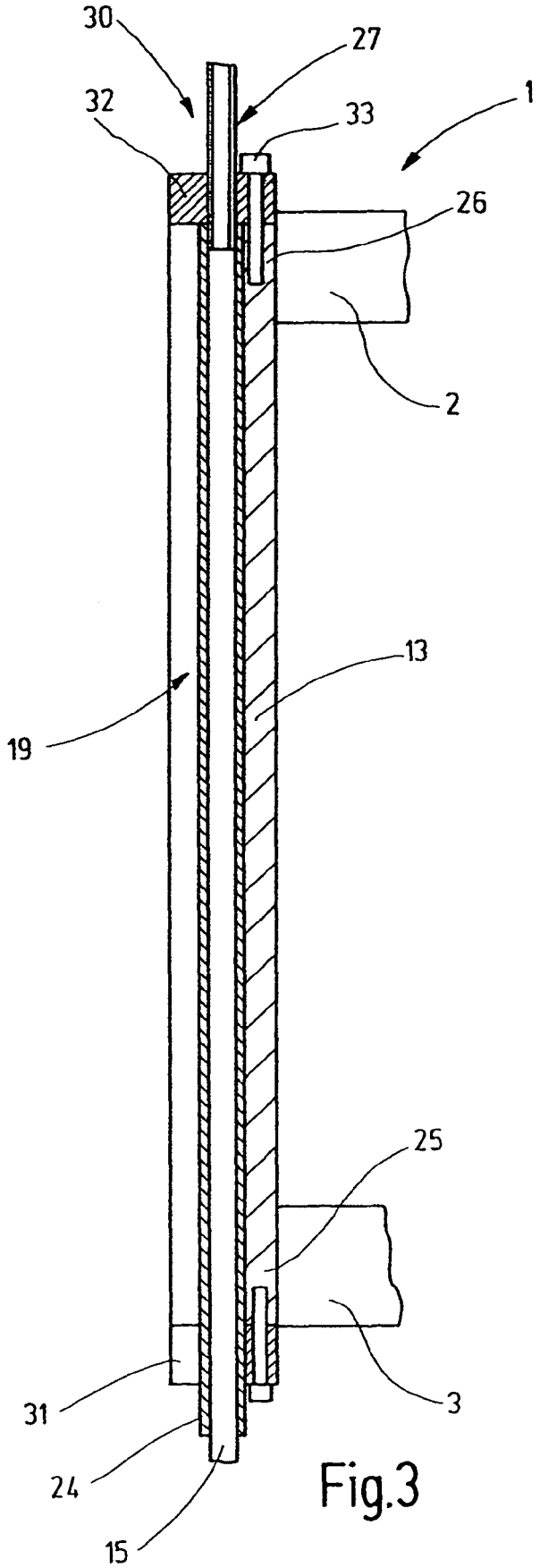
FIG. 3 is a vertical section through a modified embodiment of a lateral sampson of the heddle frame of FIG. 1.

In FIG. 3, a modified embodiment of the heddle frame 1 is shown in fragmentary form. To the extent that parts are present that are structurally or functionally the same as in the embodiment described above, the same reference numerals are used, and the above description applies accordingly.

The embodiment of the heddle frame 1 of FIG. 3 differs from the embodiment described above in that the channel 19 does not have a circumferentially closed cross section, of circular or polygonal cross section, for instance, but instead is embodied as a groove. The channel 19 is open on the side remote from the heddles. Its cross section is approximately U-shaped. Instead of the bush 29, a likewise U-shaped bracing piece 31 is provided here, which surrounds the drive rod 15 virtually without play at its intermediate layer 24 or sheathing. The bracing piece 31 is screwed to the lower end 25 of the lateral sampson 13. The drive rod 15 and the intermediate layer 24 are seated with very slight play, for instance of only 0.1 mm to 0.9 mm, in the channel 19. It is braced here on three sides by the lateral sampson 13.

On its upper end, the lateral sampson 13 has a threaded cap 32, for instance of steel, which is screwed to the lateral sampson 13. The threaded cap 32 has a threaded bore, in which the male thread 27 of the drive rod 15 is retained.

Together with the female thread, provided in the threaded cap 32, or with the threaded cap 32 itself, the male thread 27 forms a connecting device 30, which establishes the driving connection between the drive rod 15 and the heddle frame 1, or the lateral sampson 13.

This embodiment has the advantage of simple disassembly. The heddle frame can be detached from the drive rods 15, 16 by separating the threaded cap 32 from the lateral sampson 13. If needed, all that has to be done is to loosen one or a few bolts or screws 33. The drive rods 15, 16 can remain on the power loom.

Figure 4:
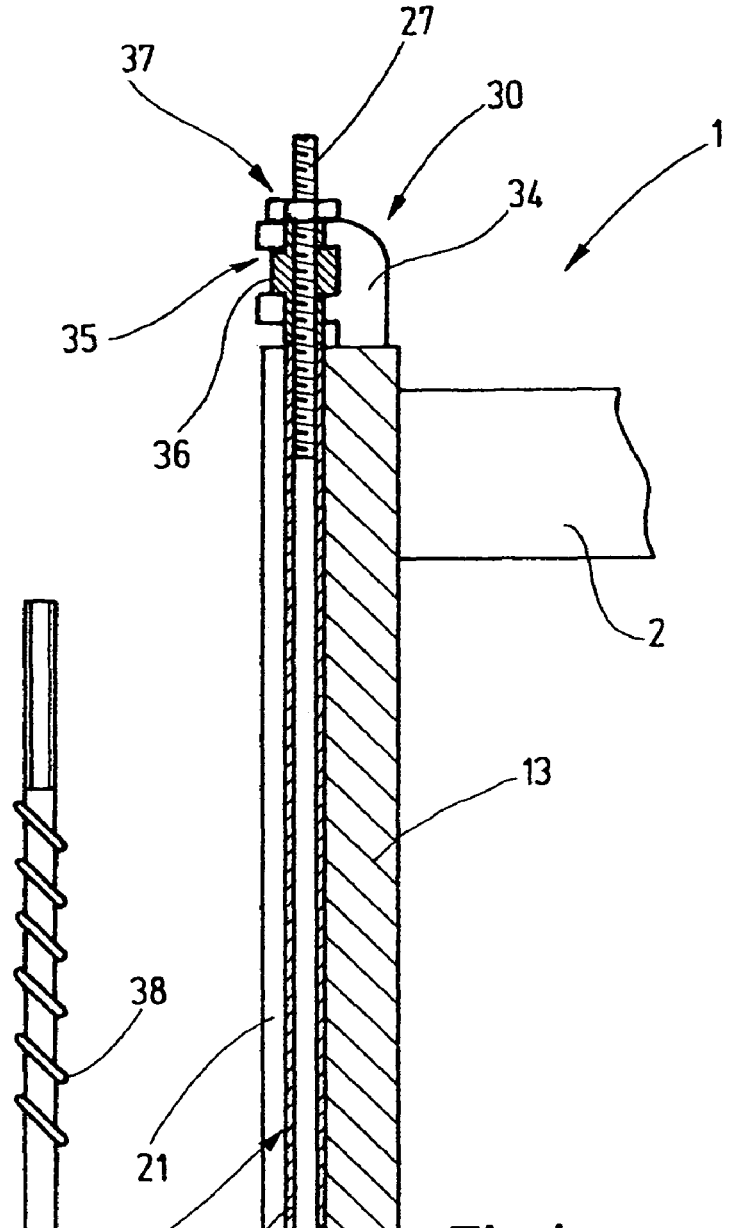
FIG. 4 is a vertical section through a further modified embodiment of a lateral sampson of the heddle frame of FIG. 1.

A further embodiment of the heddle frame 1 is shown in fragmentary form in FIG. 4. The lateral sampson 13 is again largely equivalent to the lateral sampson 13 of FIG. 3. The connecting device 30 for coupling the drive rod 15 to the lateral sampson 13 is formed here by two metal plates, kept spaced apart from and parallel to one another, of which one (the metal plate 34) is shown. It has a jawlike cutout 35, in which a head 36 that corresponds to a threaded bush is seated. This head is screwed onto the male thread 27. From above, a lock nut 37 can additionally be screwed onto the male thread 27.

In this embodiment as well, the stability of the drive rod 15 against buckling is created by the intermediate layer 24, which on the one hand fills the intermediate space 23 between the drive rod 15 and the channel wall face 21 and on the other damps the impact of the drive rod 15 against the channel wall face 21.

Figure 5:
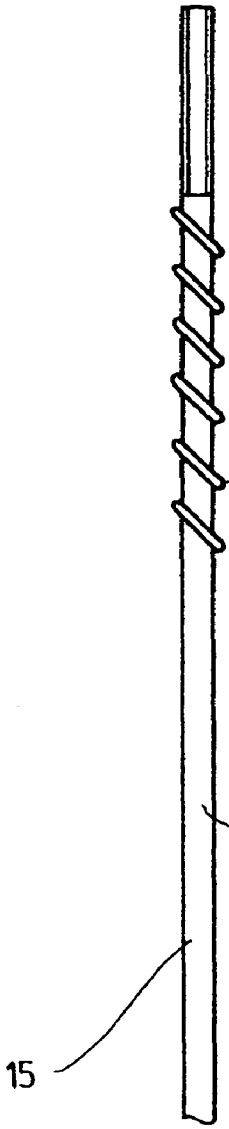
FIG. 5 is a side view of a drive rod with a modified embodiment of its sheathing.

In the above exemplary embodiments, the point of departure has initially been that the intermediate layer 24 is embodied in the form of a closed hose, so that the intermediate space 23 is essentially filled entirely. However, it is also possible to provide only selected portions of the drive rods 15,16 with an intermediate layer 24. Moreover, the intermediate layer may for instance be formed by individual elements, such as a series of O-rings, or a rubber cord 38 wrapped helically around the drive rod 15, as suggested in FIG. 5. In this case, all kinds of designs are possible in which an intermediate layer, embodied in whatever way, of a preferably damping material spans the play between the circumferential face 22 of the drive rod 15 and the channel wall face 21.

A heddle frame 1 is driven via drive rods 15, 16, which pass through its lateral sampsons 13, 14. To that end, the lateral sampsons 13, 14 each have a corresponding channel 19. The play between the circumferential face 22 of the drive rods 15, 16 and the channel wall face 21 of the respective channel 19 has an intermediate layer 24, which extends over the full length, or portions, of the drive rod 15, 16. The intermediate layer 24 preferably comprises an impact-proof, permanent-elastic, damping material. A slight residual play allows the introduction of the drive rods 15, 16 and the intermediate layer 24 into the channel 19 without force.

In summary, thus by means of three provisions, individually or together, namely supporting the drive rod 15, 16 by means of a plastic jacket; inserting a steel thread for connecting the drive rod 15, 16 to the respective lateral sampson 13, 14; and additional supporting of the drive rod 15, 16 on the lower end, facing away from the connecting device, of the channel 19, likewise in a steel receptacle, a lateral sampson that is substantially safer in operation and has a substantially longer service life is created.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Heddle frame
2, 3 Frame rods
4, 5 Support rails
6 Heddles
7 Eyelet
8, 9, 11, 12 Ends
13, 14 Lateral sampsons
15, 16 Drive rods
17, 18 End
19 Channel
21 Channel wall face
22 Circumferential face
23 Intermediate space
24 Intermediate layer
25, 26 End
27 Male thread
28 Threaded piece
29 Bush
30 Connecting device
31 Bracing piece
32 Threaded cap
33 Bolts, screws
34 Metal plate
35 Cutout
36 Head
37 Lock nut
38 Rubber cord

What is claimed is:

1. A heddle frame for a power loom, having:

two frame rods, which are kept spaced apart from one another;

two lateral sampsons, which connect the frame rods, each at their ends, to one another, and with each lateral sampson having a channel, which is formed in and extends along the entire length of the lateral sampson and which is defined by a channel wall face;

respective drive rods, which are disposed in and extend along the lengths of the respective channels so that an intermediate space is defined between the circumferential faces of the drive rods and the channel wall faces;

a connecting device for connecting a respective drive rod to a respective lateral sampson; and a respective intermediate damping layer disposed in a respective one of the intermediate spaces, only partially filling the respective intermediate space, and extending along substantially the entire length of the respective channel.

2. The heddle frame in accordance with claim 1, wherein the intermediate layer is secured to the drive rod.

3. The heddle frame in accordance with claim 2, wherein the intermediate layer surrounds the drive rod on its circumferential face.

4. The heddle frame in accordance with claim 1, wherein the intermediate layer is secured to the lateral sampson.

5. The heddle frame in accordance with claim 1, wherein the intermediate layer comprises a plastic.

6. The heddle frame in accordance with claim 1, wherein the intermediate layer comprises a permanent-elastic material.

7. The heddle frame in accordance with claim 1, wherein a play is defined between the intermediate layer and the channel wall face.

8. The heddle frame in accordance with claim 7, wherein the play is between 0.1 and 0.9 mm.

9. The heddle frame in accordance with claim 1, wherein each lateral sampson has a respective guide piece on one end for the play-free reception of the respective drive rod.

10. The heddle frame in accordance with claim 9, wherein the intermediate layer extends through the guide piece.

11. The heddle frame in accordance with claim 1, wherein the connecting device is disposed on one end of the lateral sampson.

* * * * *